US011258198B1

(12) United States Patent
Nedelea et al.

(10) Patent No.: US 11,258,198 B1
(45) Date of Patent: Feb. 22, 2022

(54) PERIPHERAL CORD LOCK

(71) Applicant: New Concepts Development Corporation, Woodstock, IL (US)

(72) Inventors: Linley Nedelea, Austin, TX (US); Matt Lee, Leander, TX (US)

(73) Assignee: New Concepts Development Corporation, Woodstock, IL (US)

( * ) Notice: Subject to any disclaimer, the term of this patent is extended or adjusted under 35 U.S.C. 154(b) by 65 days.

(21) Appl. No.: 16/503,795

(22) Filed: Jul. 5, 2019

Related U.S. Application Data

(63) Continuation-in-part of application No. 29/661,512, filed on Aug. 28, 2018.

(60) Provisional application No. 62/694,960, filed on Jul. 6, 2018.

(51) Int. Cl.
*H01R 13/621* (2006.01)

(52) U.S. Cl.
CPC ..... *H01R 13/621* (2013.01)

(58) Field of Classification Search
CPC ..... H01R 13/6215; H01R 13/621
USPC ..... 439/361, 362, 449, 465
See application file for complete search history.

(56) References Cited

U.S. PATENT DOCUMENTS 3,056,942 A * 10/1962 Carbaugh ..... H01R 13/516 439/362
5,342,216 A * 8/1994 Davis ..... H01R 13/6581 439/362
5,639,257 A * 6/1997 Yamaguchi ..... H01R 13/6215 439/364
5,774,980 A * 7/1998 Klein ..... H01R 13/5825 29/857
5,788,534 A * 8/1998 Koegel ..... H01R 13/582 439/465
6,641,429 B1 * 11/2003 Wu ..... H01R 13/5812 439/465
6,939,161 B1 9/2005 Yi
6,984,151 B2 * 1/2006 Wu ..... H01R 9/032 439/607.56
7,094,099 B2 8/2006 Daggett
7,134,899 B1 * 11/2006 Huang ..... H01R 13/6275
7,214,087 B2 * 5/2007 Kuo ..... H01R 13/6215 439/364
7,559,788 B2 7/2009 Legg
7,563,123 B2 7/2009 Cave
7,641,501 B2 * 1/2010 Uchikawa ..... H01R 13/6395 439/362
7,648,384 B2 1/2010 Desissard
7,927,126 B1 4/2011 Bender
(Continued)

OTHER PUBLICATIONS

Sonnet Technologies, Inc. TEMPO eSATA Data Cables, 1 page [retrieved from https://www.sonnettech.com/product/esata_cables.html].

(Continued)

*Primary Examiner* — Marcus E Harcum
(74) *Attorney, Agent, or Firm* — Jeffrey F. Yee; Lewis Brisbois Bisgaard & Smith LLP

(57) ABSTRACT

A device is provided adapted to firmly connect a cable end to a computer or similar electronic device. The device selectively receives and secures a cable end by way of an interference fit. The device is then interconnected to the computer, for example, with adhesives or a screw so that unintended disconnection of the cable is prevented.

8 Claims, 5 Drawing Sheets

(56) References Cited

U.S. PATENT DOCUMENTS

| | | | | |
|---|---|---|---|---|
| 7,931,497 | B2 * | 4/2011 | Yang | H01R 13/6594 439/362 |
| 8,506,320 | B1 | 8/2013 | Fu | |
| 8,696,380 | B2 * | 4/2014 | Su | H01R 13/504 439/345 |
| 8,926,358 | B2 * | 1/2015 | Kuo | H01R 13/629 439/367 |
| 9,391,402 | B2 | 7/2016 | Lin | |
| 9,425,540 | B2 * | 8/2016 | Schnurpfeil | H01R 13/506 |
| 9,627,811 | B2 | 4/2017 | Lutz | |
| 9,905,965 | B2 * | 2/2018 | Tanaka | H01R 13/6215 |
| 10,116,078 | B1 * | 10/2018 | Durse | H01R 13/502 |
| 2002/0173195 | A1 * | 11/2002 | Burger | H01R 13/6215 439/362 |
| 2004/0038564 | A1 * | 2/2004 | Yan | H01R 13/6471 439/76.1 |
| 2008/0093105 | A1 * | 4/2008 | Furusawa | H01R 13/502 174/110 SR |
| 2008/0254681 | A1 * | 10/2008 | O'Hanlan | H01R 13/6215 439/607.01 |
| 2009/0280674 | A1 * | 11/2009 | Eppright | H01R 13/6395 439/373 |
| 2010/0015838 | A1 * | 1/2010 | Blanton | H01R 13/6215 439/359 |
| 2010/0279555 | A1 * | 11/2010 | Azad | H01R 13/514 439/676 |
| 2011/0053407 | A1 * | 3/2011 | D'Addario | H01R 13/621 439/362 |
| 2011/0065309 | A1 * | 3/2011 | Lindkamp | H01R 13/5829 439/449 |
| 2012/0028496 | A1 * | 2/2012 | Su | H01R 13/6581 439/449 |
| 2012/0231653 | A1 * | 9/2012 | Ardisana | H01R 13/5812 439/449 |
| 2013/0109222 | A1 | 5/2013 | Chang | |
| 2014/0213099 | A1 * | 7/2014 | Maranto | H01R 13/5825 439/465 |
| 2014/0220810 | A1 * | 8/2014 | Lappoehn | H01R 13/6215 439/359 |
| 2018/0358860 | A1 * | 12/2018 | Major | H02K 5/10 |

OTHER PUBLICATIONS

Sonnet Technologies, Inc. ThunderLok, 2 pages [retrieved from https://sonnettech.com/product/thunderlok.html].

Sonnet Technologies, Inc. ThunderLok 3, 7 pages [retrieved from https://www.sonnetstore.com/collections/thunderbolt-cables/products/thunderlok3-2pack].

* cited by examiner

PERIPHERAL CORD LOCK

This application claims the benefit of U.S. Provisional Patent Application Ser. No. 62/694,960, filed Jul. 6, 2018, the entirety of which is incorporated by reference herein.

This application is also a Continuation-in-Part of U.S. Design patent application Serial No. 29/661,512, filed Aug. 28, 2018, the entirety of which is incorporated by reference herein.

FIELD OF THE INVENTION

Embodiments of the present invention are generally related to devices configured to secure an end of a peripheral cord to a computer or similar electronic device. The connector of one embodiment of the present invention is configured to secure a cord end that employs a Thunderbolt® USB connector.

BACKGROUND OF THE INVENTION

One of ordinary skill in the art will appreciate that cables become disconnected from computers during use. This is especially evident with respect to portable computers or similar devices. One way to address this issue has been to use screws to interconnect the cable end to the electronic device. This solution is commonly used to connect video cables from the computer to one or more monitors, wherein the cable end has at least one tab that operatively accommodates the screw. After the cable is interconnected to the monitor or the computer, one or more screws are used to fasten the cable end to the monitor/computer. One drawback of this solution is that it adds complexity and expense to the cable. In addition, because of the small form factor of many cables, e.g., those that accommodate USB connectors, similar locking mechanisms are difficult or impossible to use.

It is, thus, a long felt need to provide devices, systems, and methods that allow for the secure interconnection of peripheral cables to a computer or similar device. Embodiments of the present invention address the issues of the prior art by providing a device that interfaces with an end of existing cables so that they can be securely fastened to a computer or similar device.

SUMMARY OF THE INVENTION

It is one aspect of some embodiments of the present invention to provide a locking connector comprised of a shell that surrounds a compliant grip. The shell can be rigid, semi-rigid, or complaint. The shell of one embodiment is made of a stiff material, such as plastic or metal, and may have inwardly extending lips on its first or second end that help maintain the grip's position. Further, the shell may be manufactured in more than one piece. The shell defines a cavity defined by upper, lower, and lateral walls that interface with outer walls of the grip. The grip also provides a cavity defined by upper, lower, and the lateral walls configured to selectively receive an end of a peripheral cable and/or a portion of the cable. The locking connector of one embodiment is configured to secure the end of a USB connector. In one embodiment, the upper, lower, and lateral walls of the grip are smooth. Further, the grip, as its name implies, is made of a compliant material that snugly interfaces with the outer surface of the peripheral cable end to secure it to the shell. The shell may include a boss operatively interconnected to a screw. The locking connector is adapted to slide over the cable end and grip the same, which allows connector ends of various types and configurations to be retrofitted.

In operation, after the cable end is secured to the shell by way of the grip, the cable end is plugged into the computer and the screw is interfaced with a corresponding hole provided in the computer. Tightening the screw fixes the connector to the computer and, thus, ensures the grasped cable end maintains a secure connection that resists unintended disconnection.

It is another aspect of some embodiments of the present invention to provide alternative or additional mechanisms to interconnect the connector to the computer. For example, one embodiment of the present invention employs an adhesive member or members for situations where the electronic device does not employ a threaded hole adjacent to the port that is configured to receive the cable end, or where the connection provided by screw needs to be supplemented. In operation, the substrate is removed from the adhesive, or the adhesive is otherwise activated, and the locking connector is interconnected to the electronic device. Thereafter, the cable end is positioned within the locking connector and maintained by the grip. Alternatively, the connector end is positioned within the locking connector before it and the locking connector are attached to the electronic device and secured with the adhesive. As one of ordinary skill in the art will appreciate, using adhesive may result in a permit connection of the locking connector to the computer or similar device. Thus, selectively interconnecting systems, e.g., hook and loop fasteners, may be used instead of a more permanent, static solution.

It is still yet another aspect of some embodiments of the present invention to provide a grip with a flange having an outer extent that generally corresponds to at least a portion of the shell's outer contour. The flange creates a surface that frictionally engages the surface surrounding the port that is configured to receive the connector end. This added functionality helps prevent rotation of the shell as the screw is tightened. In addition, the interaction between the flange and the surface surrounding the female connector provides a degree of cushioning that helps counteract lateral loads experienced by the locking connector.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the drawings.

The above-described benefits, embodiments, and/or characterizations are not necessarily complete or exhaustive, and in particular, as to the patentable subject matter disclosed herein. Other benefits, embodiments, and/or characterizations of the present invention are possible utilizing, alone or in combination, as set forth above and/or described in the accompanying figures and/or in the description hereinbelow.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and drawing figures are to be understood as being approximations which may be modified in all instances as required for a particular application of the novel assembly and method described herein.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

FIG. 5 is a perspective view of a connector of another embodiment of the present invention that employs adhesive.

Figure 1:
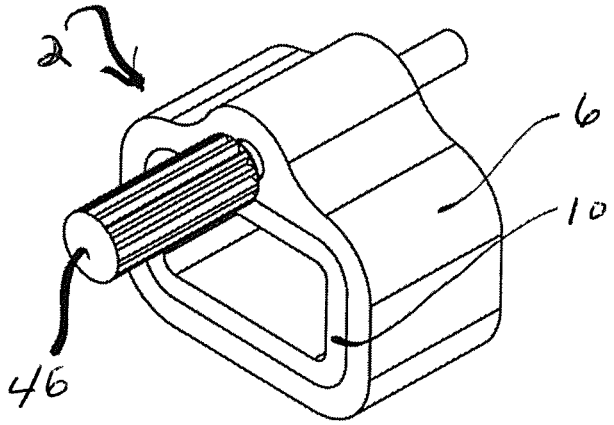
FIG. 1 is a perspective view of a connector of one embodiment of the present invention.
Figure 2:
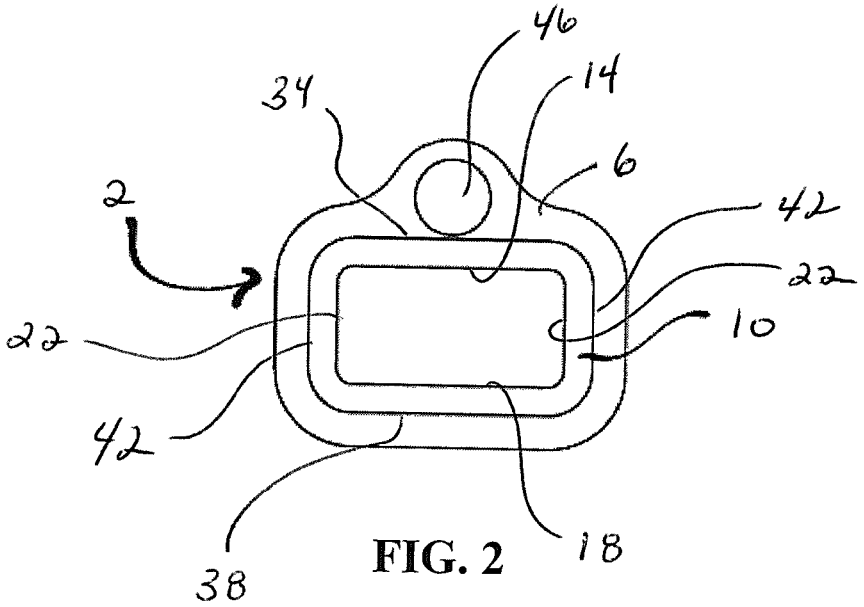
FIG. 2 is a front elevation view of FIG. 1.

The following component list and associated numbering found in the drawings is provided to assist in the understanding of one embodiment of the present invention:

COMPONENT

2 Connector
6 Shell
10 Grip
14 Upper wall
18 Lower wall
22 Lateral wall
26 Cable
30 End connector
34 Upper wall
38 Lower wall
42 Lateral wall
46 Screw
50 Adhesive
54 Flange
58 Seat
62 Outer end It should be understood that the drawings are not necessarily to scale. In certain instances, details not necessary for an understanding of the invention or that render other details difficult to perceive may have been omitted. It should be understood, the invention is not necessarily limited to the particular embodiments illustrated herein.

DETAILED DESCRIPTION

FIGS. 1-4 show a locking connector 2 of one embodiment of the present invention comprised of it shell 6 surrounding a compliant grip 10. The grip 10 is further comprised of an upper wall 14, a lower wall 18, and corresponding lateral walls 22 configured to securely engage complementary surfaces associated with a computer periphery cable 26 and/or an end connector 30. The grip 10 fits within a cavity, which is defined by an upper wall 34, lower wall 38, and corresponding lateral walls 42, integrated into the shell 6. In one embodiment, the grip 10 is interconnected to the shell 6 by way of a frictional or an interference fit. In another embodiment, the grip 10 is adhered or welded to the shell 6. The shell 6 also includes a boss that operatively receives a screw 46 used to interconnect the connector 2 to a computer.

Figure 3:
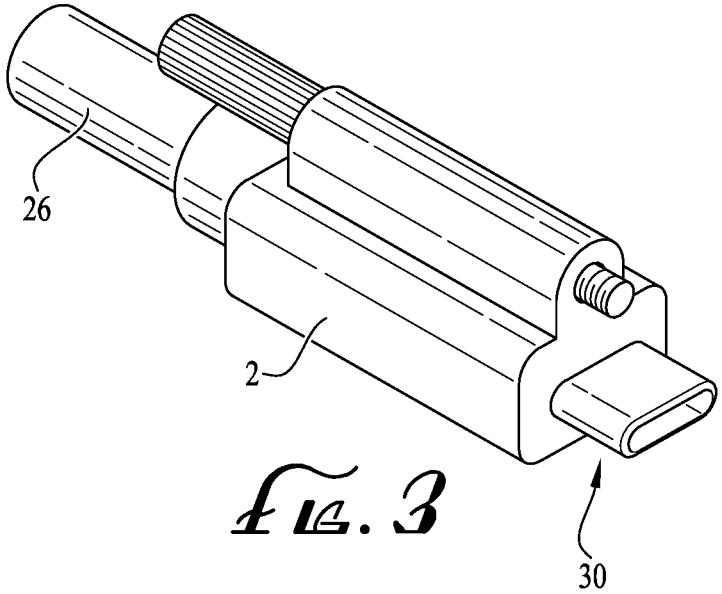
FIG. 3 is a perspective view of a connector of another embodiment of the present invention shown securing a cable that terminates in a USB connector.
Figure 4:
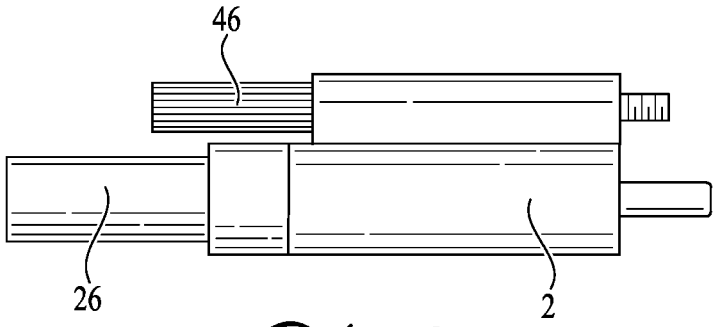
FIG. 4 is a side elevation view of FIG. 3.

FIGS. 3 and 4 shows cable end interconnected to the locking connecter 2 of one embodiment of the present invention. The grip 10 secures the connector end, wherein a male portion thereof extends away from an outer face of the locking connecter, i.e., a face that is positioned adjacent to or engages the surface around a female connector of the electronic device. The length and outer configuration of the shell 6 are not critical and can be modified to suit the intended purpose of the connection or to accommodate other cables.

Figure 5A:
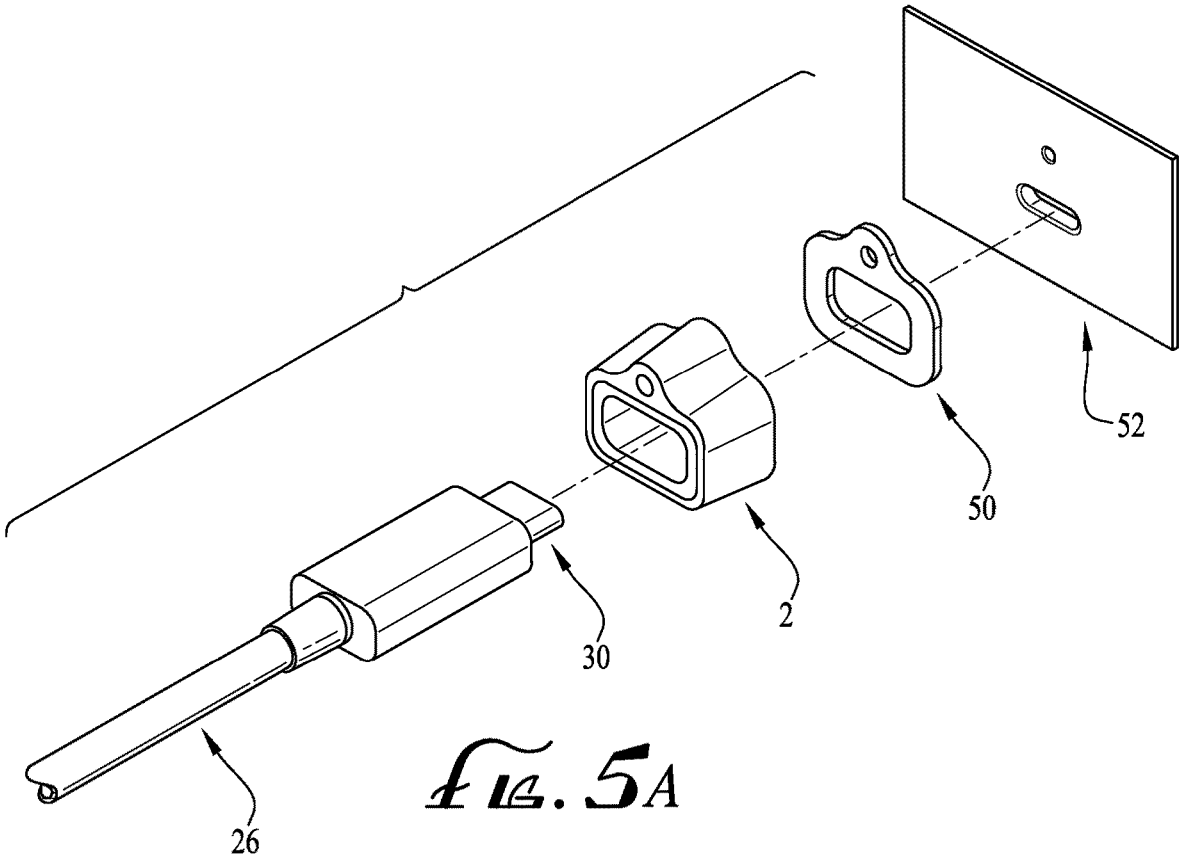
FIG. 5A is an exploded view of the connector attached to a connection port through adhesive.
Figure 5B:
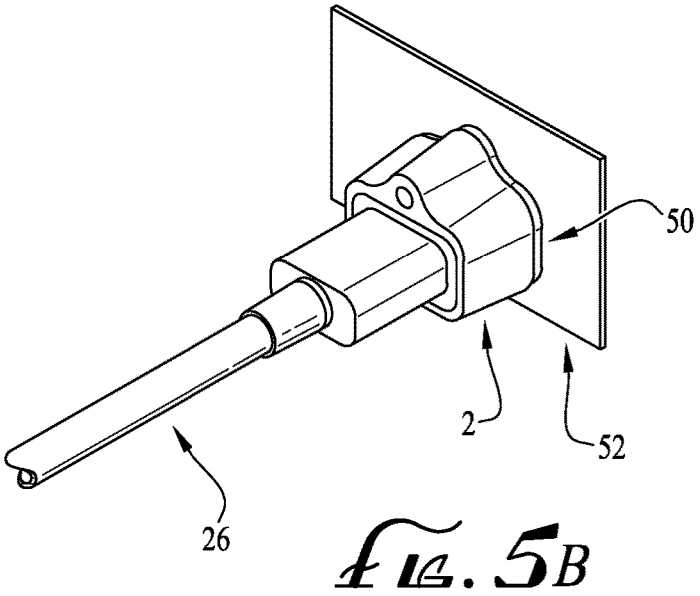
FIG. 5B is a perspective view of a connector attached to a connection port through adhesive.

FIG. 5 is a locking connector 2 of another embodiment of the present invention that does not necessarily have to employ a screw to secure it to a computer. That is, an adhesive pad 50 is employed on one surface of the locking connector 2. As shown in FIGS. 5A and 5B, a periphery cable 26 with an end connector 30 may be inserted into the locking connector 2 and then connected to a connector port 52, for example a computer USB port. The adhesive pad 50 may include adhesive on it surfaces that contact the locking connector 2 and the connector port 52 such that the locking connector 2 is securely interconnect with the surface of the connector port 52 via the adhesive pad 50 as shown in FIG. 5B.

Figure 6:
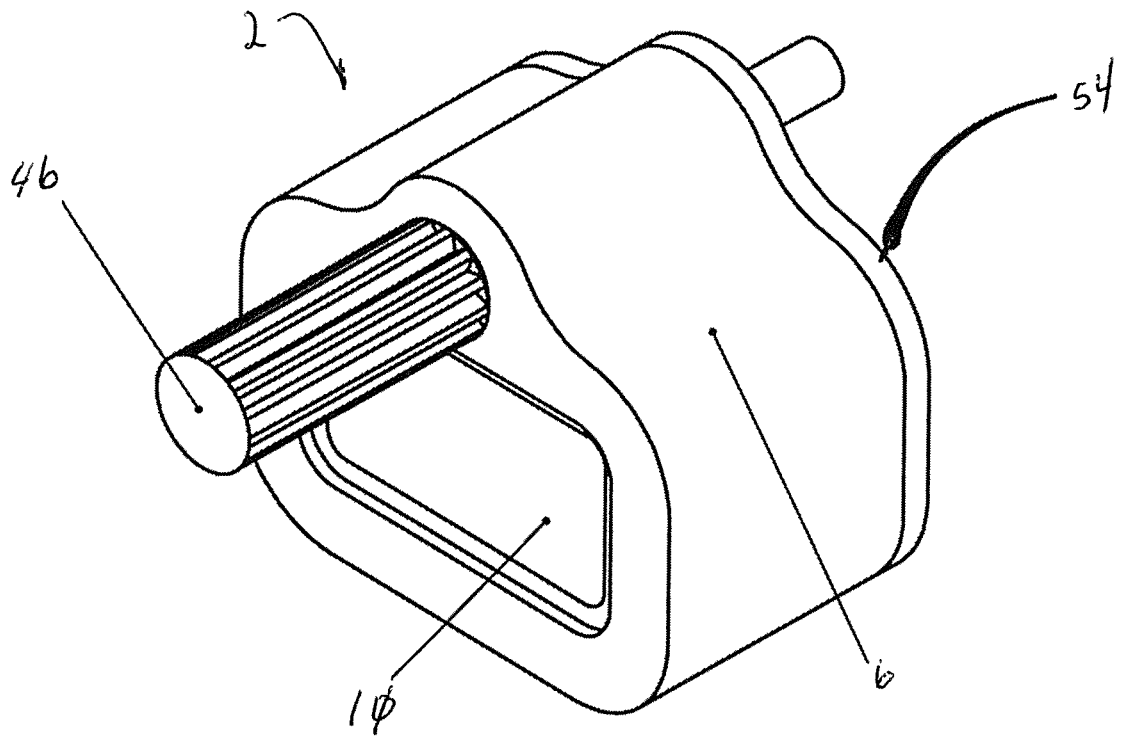
FIG. 6 is a perspective view of connector of another embodiment of the present invention that employs a grip with an outwardly-extending flange.
Figure 7:
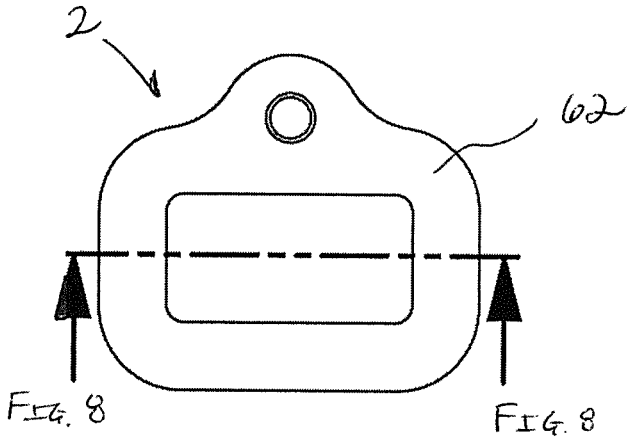
FIG. 7 is a front elevation view of the connector of FIG. 6.
Figure 8:
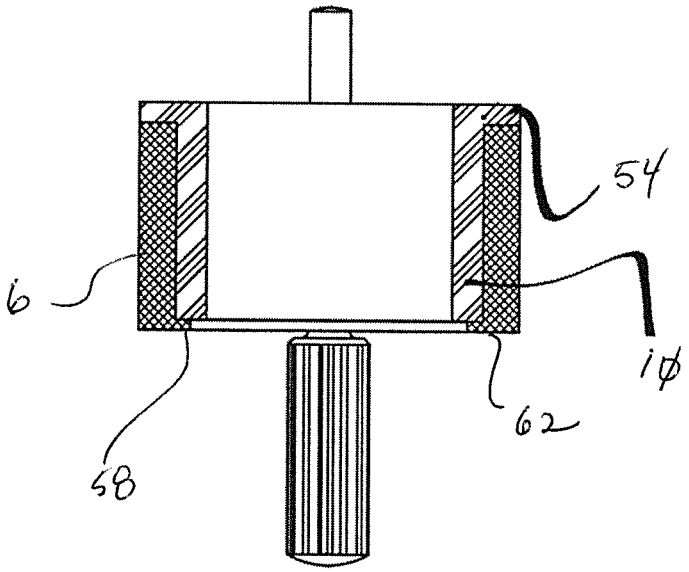
FIG. 8 is a cross-sectional view of FIG. 7.

FIGS. 6-8 show the connector 2 of another embodiment of the present invention that employs a grip 10 having an outwardly-extending flange 54. Flange 54 is designed to interface directly with the computer when the connecting mechanism, i.e., a screw, is tightened. This functionality helps maintain the position of the grip 10 relative to the shell 6. In addition, the shell 6 includes an inwardly-disposed seat 58 that engages an outer end of the grip. This aspect of some embodiments also helps maintain the position of the grip 10 within the shell 6. As one of ordinary skill in the art will appreciate, some embodiments the present invention employ both a flange 54 and a grip 58, while others only employ one of these components. Some embodiments of the present invention also include adhesive as described above associated with the flange side of the grip.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A locking connector adapted to secure a cable end to an electronic device, comprising: a shell having an outer profile with a boss wherein the boss is threaded; a grip, unmovably positioned within the shell, adopted for receiving the cable end wherein the cable end is to be connected to a connector port of the electronic device; wherein a surface of the shell or grip possesses adhesive adapted to interconnect with the electronic device; the cable end is secured by friction with the grip, without protrusions or recesses inside the grip or deforming the grip in the locking connector; a screw positioned in the boss; and wherein the screw is adapted to selectively interconnect to a corresponding connector of the electronic device to fix the cable end to the electronic device.

2. The locking connector of claim 1, wherein the shell has smooth lateral sides.

3. The locking connector of claim 1, wherein the shell does not possess clips or other means configured to maintain the cable end.

4. The locking connector of claim 1, wherein the shell has an inner surface configured to receive the grip, the inner surface comprised of planar top, bottom, and lateral surfaces.

5. The locking connector of claim 1, wherein the grip has an outward-extending flange that engages a rear surface of the shell.

6. The locking connector of claim 1, wherein the shell has an inwardly-extending flange configured to engage an end of the grip.

7. The locking connector of claim 1, wherein the grip has an outward-extending flange that engages a rear surface of the shell, and wherein the shell has an inwardly-extending flange configured to engage an end of the grip.

8. A locking connector adapted to secure a cable end to an electronic device, comprising: a shell having a threaded boss; a grip, unmovably positioned within the shell, adapted for receiving the cable end wherein the cable end is to be connected to a connector port of the electronic device; the cable end is secured by friction with the grip, without protrusions or recesses inside the grip or deforming the grip in the locking connector; a means for interconnection associated with at least one of the shell or the grip wherein the means for interconnection includes a screw located inside the boss that selectively interconnects to a corresponding threaded hole of the electronic device and also an adhesive adapted to interconnect with the electronic device; and wherein the shell does not possess clips or other means configured to secure the cable end.

* * * * *